United States Patent [19]

Morishita

[11] 4,450,423

[45] May 22, 1984

[54] MAGNETIC SWITCH

[75] Inventor: Akira Morishita, Himeji, Japan

[73] Assignee: Mitsubishi Denki Kabushiki Kaisha, Tokyo, Japan

[21] Appl. No.: 343,768

[22] Filed: Jan. 28, 1982

[30] Foreign Application Priority Data

Feb. 10, 1981 [JP] Japan ..... 56-18056[U]

[51] Int. Cl.[3] ..... H01H 51/08

[52] U.S. Cl. ..... 335/131; 335/133; 335/214

[58] Field of Search ..... 335/131, 274, 126, 133

[56] References Cited

U.S. PATENT DOCUMENTS

| | | | |
|---|---|---|---|
| 2,832,921 | 4/1958 | Horman | 335/261 |
| 3,177,728 | 4/1965 | Farison | 310/83 |
| 3,597,622 | 8/1971 | Wilson | 290/38 |
| 3,815,060 | 6/1974 | Turnbull | 335/131 |

FOREIGN PATENT DOCUMENTS

| | | | |
|---|---|---|---|
| 2804815 | 8/1979 | Fed. Rep. of Germany | 335/131 |

*Primary Examiner*—Harold Broome

*Attorney, Agent, or Firm*—Oblon, Fisher, Spivak, McClelland & Maier

[57] ABSTRACT

A return spring is placed in the center of a movable iron core and a through hole is formed in a movable contact rod to provide a pressure receiving part for reactive force on the inner wall of a cap.

2 Claims, 3 Drawing Figures

MAGNETIC SWITCH

BACKGROUND OF THE INVENTION

1. FIELD OF THE INVENTION

The present invention relates to an improvement in a magnetic switch.

2. DESCRIPTION OF THE PRIOR ART

The magnetic switch shown in FIG. 1 has been known as such device. In FIG. 1, the reference numeral (1) designates a magnetic switch: (2) designates a movable iron core having a recess (2*a*) to which a pinion shift lever (now shown) is fitted; (3) designates a return spring which is fitted to a stepped portion (2*b*) of the movable iron core (2); and (4) designates a movable contact rod made of a glass filler reinforced nylon formed by molding which is slidably fitted to the fitting hole (6*a*) of a stationary iron core (6) fixed to a casing (5) and which is slidable in contact with the end of the movable iron core (2) which is moved. The reference numeral (7) designates an electromagnetic coil wound on a bobbin (not shown) which is actuated by closing the key switch of an engine (now shown) to attract the movable iron core (2) in the left direction of the Figure and (8) designates a movable contact which is freely supported on the movable contact rod (4) and is urged by a contact spring (9) in the left direction so as to be in contact with a retaining ring (10) as a stopper. The movable contact rod (4), the movable contact (8), the contact spring (9) and the retaining ring (10) are previously assembled as a movable contact assembly to be fitted into the fitting hole (6*a*) of the stationary iron core (6). The reference numeral (11) designates a cap assembly which is fixed by crimping to the rear end of the casing (5) through a packing (12) and (13) designates a cap formed by resin molding which holds by bolting a pair of stationary contacts (14) in its two through holes (13*a*) so as to face the movable contact (8) as shown in FIG. 1. A closed contact circuit is formed by contacting the movable contact. The reference numeral (15) designates a hexagon nut, (16) designates a spring washer, (17) designates a washer and (18) designates a coil spring (mainly used to urge the movable contact assembly) which has one end in contact with the inner surface of the cap as a pressure receiving seat and the other end in contact with the retaining ring (10) to urge it in the right direction. The flange (4*a*) of the movable contact rod (4) is engaged with the stepped portion (6*b*) of the stationary iron core (6) by urging force of the coil spring.

The operation of the conventional device will be described. When the electromagnetic coil (7) is actuated by closing the key switch of the engine (now shown), the movable iron core (2) is moved in the left direction against the right side urging force of the return spring to push the movable contact rod (4). In this case, the urging force in the left direction is sufficiently larger than urging force of the coil spring (18) whereby the movable contact (8) is brought into contact with the stationary contact (14) to form a closed contact circuit. When the closed contact circuit is formed, the movable contact rod (4) is moved in the left direction for a small distance such as 1 to 2 mm because of dimensional allowance of the parts of the device. However, this movement is compensated by off-set movement (contact wiping) function by resilient deformation of the contact spring (9). The off-set movement is to self-compensate the closing function of the contacts where the contacts are worn. The electromagnetic coil acts to pull the pinion shift lever (not shown) along with the movable iron core (2) in the left direction. As soon as the key switch is opened, the urging force is released so that the magnetic switch is returned to the original position as shown in FIG. 1 by action of the return spring (3).

In the conventional magnetic switch having the structure described above, it is necessary to form a space for receiving the return spring (3) at the outer portion of the movable contact (2) whereby the diameter of the coiled spring increases. The increased diameter of the coiled spring causes increase of the diameter of the wire of the spring in order to obtain a required urging force thereby increasing a space for the return spring resulting in a large sized device. Also, leakage flux is produced in the stationary iron core (6) to reduce the performance of the magnetic switch.

SUMMARY OF THE INVENTION

It is an object of the present invention to overcome the disadvantage of the conventional magnetic switch and to provide a magnetic switch in which a return spring is placed in the center of a movable iron core and a through hole is formed in a movable contact rod to provide a pressure receiving part for a reactive force on the inner wall of a cap thereby reducing the size of the device.

The foregoing and the other objects of the present invention have been attained by providing a magnetic switch comprising an electromagnetic coil, a stationary iron core for forming a part of magnetic path by actuation of the electromagnetic coil, a movable contact assembly having a contact at the one end which is fitted in the inner hole of the stationary iron core so as to be slidable in the axial direction, a movable contact axially facing the stationary iron core to be attractive to the stationary iron core depending upon actuation of the electromagnetic coil, a pair of stationary contacts brought into contact with the movable contact of the movable contact assembly which is urged by the movable iron core, and a cap for holding the pair of stationary contacts to provide a contact chamber, which comprises a hollowed movable contact rod of the movable contact assembly and a compressive coil spring placed in the hollowed movable contact which has one end contacting the end surface of the movable iron core and the other end contacting a portion of the movable contact assembly.

DETAILED DESCRIPTION OF THE PREFERRED EMBODIMENT

Figure 2:
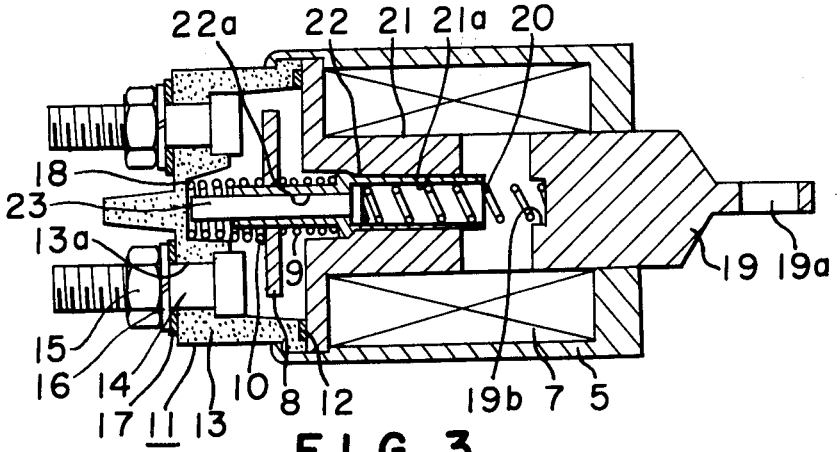
FIG. 2 is a sectional view of an embodiment of the magnetic switch of the present invention.

An embodiment of the present invention will be described with reference to FIG. 2. In the FIG. 2, the reference numeral (19) designates a movable iron core having a recess (19*a*) for connecting a shift lever and a concavity (19*b*) for receiving a return spring (20); (21) designates a stationary iron core fixed to a casing (5), the stationary iron core having a fitting hole (21*a*) for movably receiving a hollowed movable contact rod (22). The movable contact rod (22) is formed by molding a plastic material such as nylon as a main component.

The reference numeral (23) designates a rod which is freely fitted in the inner bore (22*a*) of the movable contact rod (22) and which has the front end as a pressure receiving seat for the return spring (20) and the rear end in contact with the inner wall of a cap (13) to transmit urging force. The one end of the return spring (20) is received in the inner bore (22*a*) of the movable contact rod (22) to urge the movable iron core (19).

Figure 1:
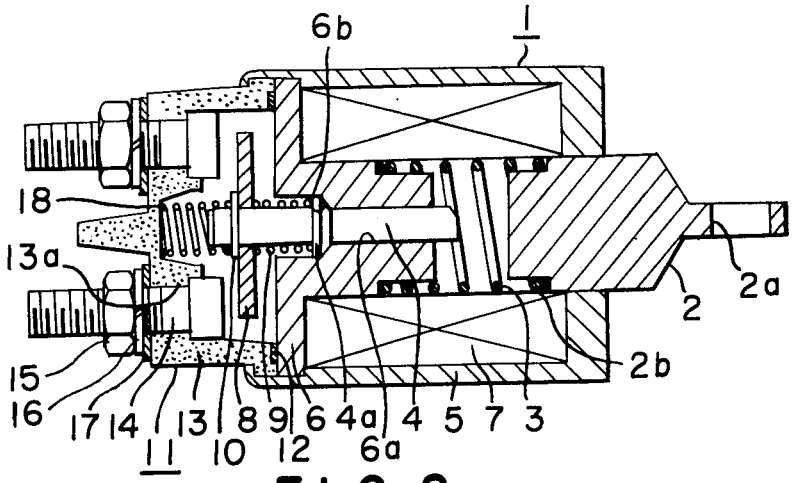
FIG. 1 PRIOR ART
FIG. 1 is a sectional view of the conventional magnetic switch.
Figure 3:
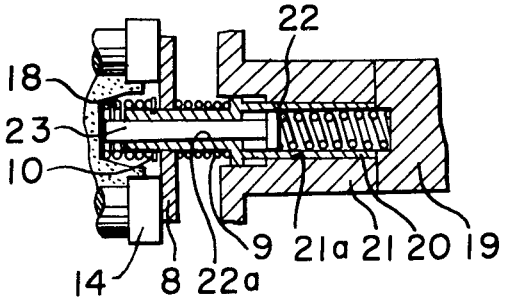
FIG. 3 is an enlarged sectional view, partly omitted, for showing the operation of the magnetic switch shown in FIG. 2.

The operation of the magnetic switch of the present invention will be described with reference to FIG. 3. When the electromagnetic coil (7) is actuated, the movable iron core (19) is attracted and moved towards the left, i.e. towards the stationary iron core (21) against the action of the spring (20). The leftward movement of the movable iron core (19) is continued until it is brought into contact with the movable contact rod (22) and urging force caused by electromagnetic coil (7) further moves the movable contact rod (22) in the left direction. As the structure of the movable contact in the movable contact rod (22) is the same as that of the conventional movable contact (8), the movable contact is brought into contact with the stationary (14) to form a closed contact circuit. In this case, off-set function (contact wiping) is attained by deformation of a contact spring (9) as similar to the conventional magnetic switch shown in FIG. 1. At that state, a rightward urging force is simultaneously applied to the movable iron core (19) by the contact spring (9), the coil spring (18) and the return spring (20). However, urging force by the electromagnetic coil (7) is so large that a state as shown in the FIG. 3 is maintained. When actuation of the electromagnetic coil (7) is released, the movable iron core (19), the movable contact rod (22) and the movable contact (8) are returned to the state as shown in FIG. 2 by combined urging force of springs (9), (18), (20).

In the embodiment described above, a reactive force of the return spring (20) is transmitted through the rod (23) to the inner wall of the cap (13) to form a pressure receiving structure. A similar effect can be obtained by using an elongated spring to directly urge the inner wall of the cap (13).

In accordance with the present invention, a pressure receiving structure for transmitting reactive force of the return spring of the movable iron core to the inner wall of the cap is provided whereby a space factor for receiving the return spring is improved to reduce the size of a magnetic switch and to provide an improved magnetic path by cutting leakage flux directly passing in the movable and stationary iron cores through the return spring.

I claim:

1. In a magnetic switch comprising an electromagnetic coil, a movable iron core, a stationary iron core for forming a part of a magnetic path by the actuation of said electromagnetic coil, a movable contact assembly having a contact at one end which is fitted to a inner hole of said stationary iron core so as to be slidable in the axial direction wherein said contact assembly further includes a movable contact axially facing said stationary iron core to be attractive to said stationary iron core depending upon actuation of said electromagnetic coil, a pair of stationary contacts brought into contact with said movable contact of the movable contact assembly when moved by said movable iron core, and a cap for holding said pair of stationary contacts to provide a contact chamber, an improvement wherein said movable contact assembly further comprises a hollowed movable contact rod and a compressive coil spring placed in said hollowed movable contact rod which has one end contacting an end surface of said movable iron core and the other end operably arranged in said movable contact assembly to bias said movable iron core away from said movable contact assembly.

2. A magnetic switch assembly according to claim 1, wherein said hollow movable contact rod includes a second movable contact rod therein, having a pressure receiving portion contacting said other end of said compressive coil spring for receiving force of said spring.

* * * * *